US008663069B2

(12) United States Patent
Foley et al.

(10) Patent No.: US 8,663,069 B2
(45) Date of Patent: Mar. 4, 2014

(54) RESPIRATORY MUSCLE ENDURANCE TRAINING DEVICE AND METHOD FOR THE USE THEREOF

(75) Inventors: Martin P. Foley, London (CA); Jerry R. Grychowski, Lake Zurich, IL (US)

(73) Assignee: Trudell Medical International, London, Ontario (CA)

( * ) Notice: Subject to any disclaimer, the term of this patent is extended or adjusted under 35 U.S.C. 154(b) by 0 days.

(21) Appl. No.: 13/357,914

(22) Filed: Jan. 25, 2012

(65) Prior Publication Data

US 2012/0270703 A1 Oct. 25, 2012

Related U.S. Application Data

(63) Continuation of application No. 12/388,952, filed on Feb. 19, 2009, now Pat. No. 8,118,713.

(60) Provisional application No. 61/030,436, filed on Feb. 21, 2008.

(51) Int. Cl.
*A63B 21/00* (2006.01)

(52) U.S. Cl.
USPC ..... 482/13; 482/11

(58) Field of Classification Search
USPC ..... 482/13, 11; 600/540, 532; 128/200.24
See application file for complete search history.

(56) References Cited

U.S. PATENT DOCUMENTS

| | | | |
|---|---|---|---|
| 393,869 | A | 12/1888 | Warren |
| 2,007,330 | A | 7/1935 | Hicks |
| 2,304,033 | A | 12/1942 | Shelton |
| 2,321,256 | A | 6/1943 | Shelton |
| 2,670,739 | A | 3/1954 | McNeill |
| 3,455,294 | A | 7/1969 | Adler et al. |
| 3,863,914 | A | 2/1975 | O'Connor |
| 3,949,984 | A | 4/1976 | Navara |
| 4,182,366 | A | 1/1980 | Boehringer |
| 4,192,301 | A | 3/1980 | Hardwick |
| 4,221,381 | A | 9/1980 | Ericson |
| 4,231,375 | A | 11/1980 | Boehringer et al. |
| 4,267,832 | A | 5/1981 | Häkkinen |

(Continued)

FOREIGN PATENT DOCUMENTS

| | | |
|---|---|---|
| DE | 199 12 337 C1 | 8/2000 |
| EP | 0 027 154 A | 4/1981 |

(Continued)

OTHER PUBLICATIONS

Office Action from Japanese Application No. 2009-525613, dated Apr. 3, 2012, 4 pages (with translation).

(Continued)

*Primary Examiner* — Jerome w Donnelly
(74) *Attorney, Agent, or Firm* — Brinks, Gilson & Lione

(57) ABSTRACT

A respiratory muscle endurance training device (RMET) includes a chamber and a patient interface. In one implementation, one or both of a $CO_2$ sensor or a temperature sensor can be coupled to the chamber or patient interface to provide the user or caregiver with indicia about the $CO_2$ level in, or the temperature of, the chamber or patient interface, and/or the duration of use of the device. In another implementation, the RMET may have a fixed volume portion adjustable to contain a measured portion of a specific patient's inspiratory volume capacity. Methods of using the device are also provided.

30 Claims, 16 Drawing Sheets

(56) References Cited

U.S. PATENT DOCUMENTS

| | | | | |
|---|---|---|---|---|
| 4,275,722 | A | 6/1981 | Sorensen | |
| 4,291,704 | A | 9/1981 | Petty et al. | |
| 4,298,023 | A | 11/1981 | McGinnis | |
| 4,301,810 | A | 11/1981 | Belman | |
| 4,470,412 | A | 9/1984 | Nowacki et al. | |
| 4,508,116 | A | 4/1985 | Duncan et al. | |
| 4,627,432 | A | 12/1986 | Newell et al. | |
| 4,628,926 | A | 12/1986 | Duncan et al. | |
| 4,635,631 | A | 1/1987 | Izumi | |
| 4,739,987 | A * | 4/1988 | Nicholson | 482/13 |
| 4,770,413 | A | 9/1988 | Green | |
| 4,854,574 | A | 8/1989 | Larson et al. | |
| 4,938,210 | A | 7/1990 | Shene | |
| 4,973,047 | A | 11/1990 | Norell | |
| 4,981,295 | A | 1/1991 | Belman et al. | |
| 5,042,467 | A | 8/1991 | Foley | |
| 5,103,854 | A | 4/1992 | Bailey et al. | |
| 5,154,167 | A | 10/1992 | Hepburn | |
| 5,165,393 | A | 11/1992 | Kawaguchi | |
| 5,193,529 | A | 3/1993 | Labaere | |
| 5,245,991 | A | 9/1993 | Kawaguchi | |
| 5,385,140 | A | 1/1995 | Smith | |
| 5,479,920 | A | 1/1996 | Piper et al. | |
| 5,582,162 | A | 12/1996 | Petersson | |
| 5,598,839 | A | 2/1997 | Niles et al. | |
| 5,645,049 | A | 7/1997 | Foley et al. | |
| 5,647,345 | A | 7/1997 | Saul | |
| 5,658,221 | A | 8/1997 | Hougen | |
| 5,740,793 | A | 4/1998 | Hodson et al. | |
| 5,749,368 | A | 5/1998 | Kase | |
| 5,755,640 | A | 5/1998 | Frolov et al. | |
| 5,816,240 | A | 10/1998 | Komesaroff | |
| 5,848,588 | A | 12/1998 | Foley et al. | |
| 5,890,998 | A | 4/1999 | Hougen | |
| 5,899,832 | A | 5/1999 | Hougen | |
| 5,925,831 | A | 7/1999 | Storsved | |
| 6,026,807 | A | 2/2000 | Puderbaugh et al. | |
| 6,039,042 | A | 3/2000 | Sladek | |
| 6,044,841 | A | 4/2000 | Verdum et al. | |
| 6,083,141 | A * | 7/2000 | Hougen | 482/13 |
| 6,089,105 | A | 7/2000 | Ricciardelli | |
| 6,116,239 | A | 9/2000 | Volgyesi | |
| 6,165,105 | A | 12/2000 | Boutellier et al. | |
| 6,240,917 | B1 | 6/2001 | Andrade | |
| 6,293,279 | B1 | 9/2001 | Schmidt et al. | |
| 6,345,617 | B1 | 2/2002 | Engelbreth et al. | |
| 6,390,090 | B1 | 5/2002 | Piper | |
| 6,408,848 | B1 | 6/2002 | Feldman et al. | |
| 6,412,481 | B1 | 7/2002 | Bienvenu et al. | |
| 6,435,177 | B1 | 8/2002 | Schmidt et al. | |
| 6,500,095 | B1 | 12/2002 | Hougen | |
| 6,557,549 | B2 | 5/2003 | Schmidt et al. | |
| 6,631,716 | B1 | 10/2003 | Robinson et al. | |
| 6,848,443 | B2 | 2/2005 | Schmidt et al. | |
| 6,880,557 | B2 | 4/2005 | Downey | |
| 6,904,908 | B2 | 6/2005 | Bruce et al. | |
| 7,201,164 | B2 | 4/2007 | Grychowski et al. | |
| 7,201,167 | B2 | 4/2007 | Fink et al. | |
| 2002/0069870 | A1 | 6/2002 | Farmer | |
| 2002/0104531 | A1 | 8/2002 | Malone | |
| 2002/0115533 | A1 | 8/2002 | Horstel et al. | |
| 2003/0131844 | A1 | 7/2003 | Kumar et al. | |
| 2004/0003808 | A1 | 1/2004 | Fuhrman et al. | |
| 2004/0146842 | A1 | 7/2004 | Carlucci et al. | |
| 2005/0005929 | A1 | 1/2005 | Snyder et al. | |
| 2005/0217666 | A1 | 10/2005 | Fink et al. | |
| 2008/0096728 | A1 | 4/2008 | Foley et al. | |

FOREIGN PATENT DOCUMENTS

| | | | |
|---|---|---|---|
| EP | 0 372 148 | A1 | 6/1990 |
| EP | 0 678 306 | A2 | 10/1995 |
| EP | 1 021 225 | B1 | 4/1999 |
| EP | 0 938 908 | A2 | 9/1999 |
| EP | 1 377 347 | B1 | 1/2004 |
| EP | 1 485 157 | B1 | 3/2007 |
| GB | 2 238 728 | A | 6/1991 |
| GB | 2 278 545 | A | 12/1994 |
| JP | 11-507258 | A | 6/1999 |
| WO | WO 96/40376 | A1 | 12/1996 |
| WO | WO 99/16490 | A1 | 4/1999 |
| WO | WO 00/27455 | A1 | 5/2000 |
| WO | WO 01/39837 | A1 | 6/2001 |
| WO | WO 02/081034 | A2 | 10/2002 |
| WO | WO 2004/011071 | A1 | 2/2004 |
| WO | WO 2008/024375 | A3 | 2/2008 |

OTHER PUBLICATIONS

Koppers, M.D., Ralph J.H., Vos, M.D., Ph.D., Petra J.E., Boot, Ph.D., Cecile R.L., and Folgering, M.D., Ph.D., Hans Th.M., "Exercise Performance Improves in Patients With COPD due to Respiratory Muscle Endurance Training," Manuscript—Original Research COPD, American College of Chest Physicians (www.chestjournal.org/misc/reprints.shtml), Apr. 2006, pp. 886-892.

"FEMEN® $CO_2$ Indicator—Innovative Technology for $CO_2$ Indication," Engineered Medical Systems, Inc., Indianapolis, IN, USA, date unknown, 2 pages.

International Search Report in International Application No. PCT/US2007/018527, dated Feb. 20, 2008, 4 pages.

Written Opinion in International Application No. PCT/US2007/018527, dated Feb. 20, 2008, 9 pages.

International Preliminary Report on Patentability for International Application No. PCT/US2007/018527, dated Feb. 24, 2009, 9 pages.

Partial International Search Results for International Application No. PCT/US2009/034474, dated May 18, 2009, 2 pages.

International Search Report in International Application No. PCT/US2009/034474, dated Aug. 28, 2009, 8 pages.

Written Opinion of the International Searching Authority for International Application No. PCT/US2009/034474, dated Aug. 28, 2009, 8 pages.

International Preliminary Report on Patentability for International Application No. PCT/US2009/034474, dated Aug. 24, 2010, 7 pages.

Office Action from U.S. Appl. No. 11/842,778, dated Oct. 28, 2010, 4 pages.

Office Action from U.S. Appl. No. 11/842,778, dated May 16, 2011, 7 pages.

Reply to Oct. 6, 2008 Office Action filed Jan. 5, 2009 in U.S. Appl. No. 10/774,751, 14 pages.

European Search Report in European Application No. 10 19 2608, mailed May 3, 2011, 6 pages.

J.B. Andersen et al., "A new Mode of Administration of Nebulized Bronchodilator in Severe Bronchospasm", Eur. J. Respir Dis Suppl 119, vol. 63, 1982, pp. 97-100.

E.F. Christensen et al., "Treatment of Bronchial Asthma with Terbutaline Inhaled by Conespacer Combined With Positive Expiratory Pressure Mask", Chest 100, vol. 2, Aug. 1991, pp. 317-321.

M.J. Mahlmeister et al., "Positive-Expiratory-Pressure Mask Therapy: Theoretical and Practical Considerations and a Review of the Literature", Respiratory Care Nov. 1991, vol. 36, No. 11, pp. 1218-1229.

J.L. Rau et al., "Combining a Positive Expiratory Pressure Device with a Metered-Dose Inhaler Reservoir System Using Chlorofluorocarbon Albuterol and Hydrofluoroalkane Albuterol: Effect on Dose and Particle Size Distributions", Respiratory Care, Mar. 2000, vol. 45 No. 3, pp. 320-326.

R. Wilson, "Positive Expiratory Pressure Therapy: The Key to Effective, Low-cost Removal of Bronchial Secretions", The Journal for Respiratory Care Practitioners, Mar. 1999, pp. 67-68.

Unknown author, "AARC Clinical Practice Guideline: Use of Positive Airway Pressure Adjuncts to Bronchial Hygiene Therapy", Respiratory Care, May 1993, vol. 38 No. 5, pp. 516-520.

Unknown author, "Technology Showcase Adjuncts to Bronchial Hygiene Therapy", AARC Times, May 1998, 2 pages.

(56) References Cited

OTHER PUBLICATIONS

Unknown author, Pamphlet for "TheraPEP:Positive Expiratory Pressure Therapy System", Catalog No. 20-1112, published prior to Apr. 11, 2001, 4 pages.
Unknown author, Pamphlet for "PARI PEP System", Part No. 18F61, published prior to Apr. 11, 2001, 3 pages.
Application as filed for U.S. Appl. No. 09/287,997, filed Apr. 7, 1999, 65 pages.
Claims as filed for U.S. Appl. No. 08/938,686, filed Sep. 26, 1997, 8 pages.
International Search Report for International Application No. PCT/IB01/00599, dated Nov. 9, 2001, 4 pages.

* cited by examiner 410
406
392
404
396
390
400
398
408

RESPIRATORY MUSCLE ENDURANCE TRAINING DEVICE AND METHOD FOR THE USE THEREOF

This application is a continuation of U.S. patent application Ser. No. 12/388,952, filed Feb. 19, 2009, which application claims the benefit of U.S. Provisional Patent Application Ser. No. 61/030,436, filed Feb. 21, 2008, the entire disclosures of which are hereby incorporated herein by reference.

TECHNICAL FIELD

The present disclosure relates generally to a training device, and in particular, to a respiratory muscle endurance training device.

BACKGROUND

Patients with respiratory ailments, in particular patients with COPD (Chronic Obstructive Pulmonary Disease), have impaired exercise tolerance and diminished ventilatory efficiency. For example, one symptom of both asthma and COPD is Dyspnoea. Dyspnoea, exercise limitation and reduced quality of life are common features of COPD. Dyspnoea induces a progressive downward spiral that starts with physical activity. Thus, the intensity of Dyspnoea is increased when changes in respiratory muscle length or tension are inappropriate for the outgoing motor command, or when the requirement for respiratory work becomes excessive.

There are a multitude of inputs to the sensation of Dyspnoea, few of which are readily modifiable. Dyspnoea may be alleviated by reducing the load placed upon the inspiratory muscles. Patients with COPD frequently have inspiratory muscle dysfunction, exhibiting weakness and reduced endurance. Patients with COPD may be well adapted to generating low flow rates for long periods of time, but this adaptation may rob them of the ability to generate the high pressures and flow rates required during exercise. The demand for exercise ventilation in patients with COPD may be elevated by their deconditioned state, inefficient breathing patterns, and gas exchange impairment.

Various techniques have been developed to improve respiratory muscle endurance capacity. For example, one technique involves respiratory muscle training through the use of positive expiratory pressure devices, such as the AEROPEP PLUS valved holding chamber available from Trudell Medical International, the Assignee of the present application.

Another technique is referred to as Respiratory Muscle Endurance Training (RMET). Most current RMET techniques require complicated and expensive equipment, which limits widespread use. Alternatively, a portable tube has been developed for use by COPD patients, and has been effective in improving the endurance exercise capacity of the users.

SUMMARY

A respiratory muscle endurance training device includes a chamber and a patient interface. One or both of a $CO_2$ sensor or a temperature sensor can be coupled to the chamber or patient interface to provide the user or caregiver with indicia about the $CO_2$ level in, or the temperature of, the chamber or patient interface, and/or the duration of use of the device. In various embodiments, one-way inhalation and exhalation valves and flow indicators can also be associated with the chamber or patient interface.

In one aspect of the invention, a respiratory muscle endurance training device includes a patient interface for transferring a patient's exhaled or inhaled gases and a fixed volume chamber in communication with the patient interface, where the fixed volume chamber is sized to retain a portion of a patient's exhaled gases. A variable volume chamber in communication with the fixed volume chamber, where the variable volume chamber is configured to be responsive to the patient's exhaled or inhaled gases to move from a first position to a second position. A variable orifice may be positioned on the variable volume chamber to permit a desired amount of exhaled air to escape during exhalation and to receive a supply of air to replace the escaped exhaled air during inhalation.

Methods of using the device are also provided. In particular, the user inhales and exhales into the chamber. Over the course of a plurality of breathing cycles, the $CO_2$ level in the chamber increases, thereby increasing the work of breathing and exercising the user's lungs. In other embodiments, a visual or audible indicator which may be located on the housing of the device may provide flashes or beeps, respectively, to prompt a patient to inhale or exhale at each such indication. In yet other embodiments, a visual or audible indicator that is separate from the device may be used to assist a patient in establishing the desirable breathing pattern.

The various embodiments and aspects provide significant advantages over other respiratory muscle training devices. In particular, the training device is portable and the volume can be easily adjusted to accommodate different users, for example those with COPD, as well as athletes with healthy lungs. In addition, the user or care giver can quickly and easily assess the level or duration of use by way of various sensors, thereby providing additional feedback as to the proper use of the device. As such, pulmonary rehabilitation using respiratory muscle training can be implemented safely, for example and without limitation, in a home-based setting, thereby providing a relatively accessible non-pharmacological treatment for Dyspnoea, or other aspects of COPD, that also improve exercise intolerance and quality of life.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
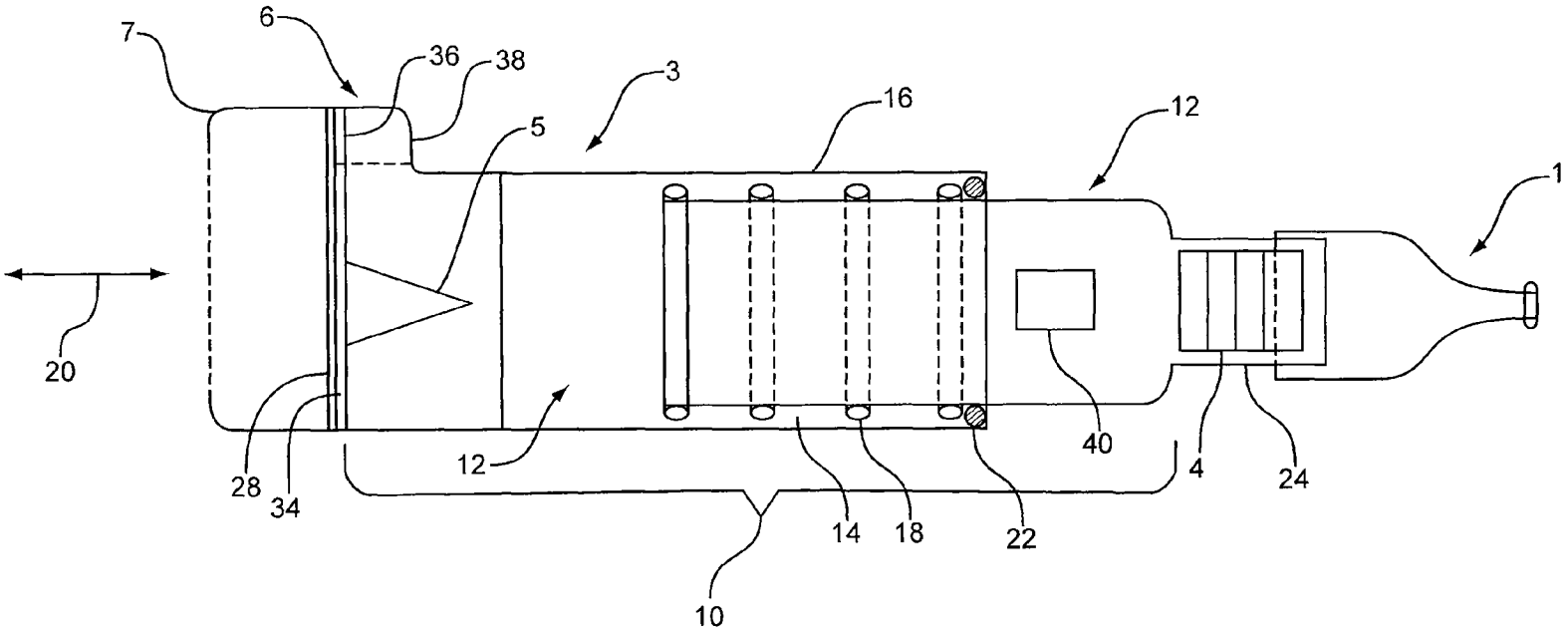
FIG. 1 is a side view of one embodiment of a respiratory muscle endurance training device.

Referring to FIG. 1, a respiratory muscle endurance training device includes a chamber 10, otherwise referred to as a spacer. In one embodiment, the chamber includes a first chamber component 2 and a second chamber component 3. In other embodiments, the chamber 10 is formed as a single unitary component. The first and second chambers define an interior volume 12 of the chamber.

In one embodiment, mating portions 14, 16 of the first and second chambers are configured as cylindrical portions or tubes, with the first chamber component 2 having an outer diameter shaped to fit within an inner diameter of the second chamber component 3. One or both of the chamber components are configured with circumferential ribs 18 and/or seals (shown in FIG. 1 on the first chamber component) that mate with the other chamber to substantially prevent exhaled air from escaping from the chamber interface. In one embodiment, the ribs 18 are spaced apart along the lengths of one or both of the chamber components so as to allow the chambers to be moved longitudinally in a longitudinal direction 20 relative to each other and then fixed at different lengths depending on the location of the ribs 18 and a mating shoulder 22 formed on the other chamber (shown in FIG. 1 as the second chamber component). The rings, or ribs, and shoulder are preferably integrally molded with the chambers, although they can also be affixed separately, e.g., as an o-ring. It should be understood that various detent mechanisms, including springs, tabs, etc. can be used to index the first chamber component relative to the second chamber component. Of course, it should be understood that the chambers can also be infinitely adjustable without any set detents, for example with a simple friction fit between the chamber components.

When adjusted, the overall interior volume 12 of the chamber 10 can be adjusted. For example, the interior volume 12 of the chamber can be adjusted from between about 500 cc to about 4000 cc. The chamber volume is adjusted depending on various predetermined characteristics of the user, such as peak expiratory flow. In this way, the interior volume 12 can be adjusted to reduce or increase the total exhaled volume of expired gases captured inside the chamber 10.

The first chamber component 2 includes an output end 24 that is coupled to a patient interface 1. It should be understood that the terms "coupling," "coupled," and variations thereof, mean directly or indirectly, and can include for example a patient interface in-molded with the first chamber at an output end thereof. The patient interface can be configured, without limitation, as a mask, a mouthpiece, a ventilator tube, etc. The term "output" merely refers to the fact that gas or air moves through or from the chamber to the patient interface during inhalation, notwithstanding that gas or air moves from the patient interface into the chamber during exhalation. The term "end" refers to a portion of the chamber that has an opening through which the gas or air moves, and can refer, for example, to a location on a spherical chamber having such an opening, with that portion of the sphere forming the "end."

The second chamber component 3 includes an input end 28, wherein air or gas flows into the chamber 10. The chamber preferably includes a one-way inhalation valve 5 that allows ambient air, or aerosol from an aerosol delivery device, to flow in a one-way direction through the input end 28 of the second chamber component and into the interior volume 12. During an exhalation sequence of the user, an exhalation valve 34 opens to allow exhaled gases to escape to the ambient air. The inhalation valve 5 is preferably configured as a duckbill valve, although other valves such as slit petal valves, center post valves, valves having a central opening with a peripheral sealing edge, etc. would also work. One acceptable valve is the valve used in the AEROPEP PLUS device, available from Trudell Medical International.

The exhalation valve 34 is preferably formed around a periphery of the inhalation valve. The second chamber 3 also includes a flow indicator 36, formed as a thin flexible member disposed in a viewing portion 38 formed on the second chamber, or as part of a valve cap 6. The flow indicator is configured to move during inhalation or exhalation to provide indicia to the user or caregiver that an adequate flow is being generated in the device. Various embodiments of the flow indicator and inhalation and exhalation valves are disclosed for example and without limitation in U.S. Pat. No. 6,904,908, assigned to Trudell Medical International, London, Ontario, Canada, the entire disclosure of which is hereby incorporated herein by reference. Examples of various aerosol delivery systems and valve arrangements are disclosed in U.S. Pat. Nos. 4,627,432, 5,385,140 5,582,162, 5,740,793, 5,816,240, 6,026,807, 6,039,042, 6,116,239, 6,293,279, 6,345,617, and 6,435,177, the entire contents of each of which are incorporated herein by reference. A valve chamber 7 is coupled to the input end of the second chamber. The valve chamber isolates and protects the valves from being contaminated or damaged, and further provides for coupling to a substance delivery device such as a tube or an aerosol delivery device.

The chamber 10, for example the first chamber component 2 and/or the patient interface 1, is configured with a $CO_2$ sensor 4, for example and without limitation a $CO_2$ Fenem colormetric indicator available from Engineering Medical Systems, located in Indianapolis, Ind. The $CO_2$ indicator 4 provides visual feedback to the user and/or caregiver as to what the $CO_2$ level is in the chamber 10, or the interior spaced defined by the chamber 10 and the patient interface 1, to ensure that the $CO_2$ level is sufficient to achieve the intended therapeutic benefit. As shown in FIG. 1, the sensor 4 is located at the output end of the chamber 10 adjacent the patient interface 1, or at the juncture of those components, whether formed integrally or separately. Of course, it should be understood that the sensor 4 can be located directly on or in the patient interface 1, or on or in either of the first and second chamber components 2, 3.

The expendable $CO_2$ indicator 4 is configured with user indicia to indicate the level of $CO_2$ in the chamber or interior. The indicator 4 includes a litmus paper with a chemical paper having a chemical material that reacts to the $CO_2$ concentration in a gas. For example and without limitation, the color purple indicates an atmospheric concentration of $CO_2$ molecules less than 0.03%. The color changes to a tan color at 2.0% $CO_2$ in the gas. The color yellow indicates 5.0% or more $CO_2$ concentration. At this level, the patient is re-inhaling expired gases (or dead space gases) to increase the concentration of $CO_2$ in the lungs of the user, which encourages the user to inhale deeper, thereby exercising the lung muscles to expand beyond their normal condition. The sensor and indicator 4 can be used to determine the $CO_2$ level, or the length of the time the user has been using the device. After use, the indicator 4 holds the reading for a period of time, so that a caregiver who is temporarily absent can get a reading after the use cycle is completed. Eventually the indicator will reset by returning to its original color scheme, such that it can be used again. The device is compact and lightweight, and is thus very portable.

The device can also be configured with a temperature sensor 40, such as a thermochromic liquid crystals strip, available from Hallcrest Inc., Glenview Ill. The temperature sensor 40 is secured to the outside (or inside) of one of the chamber or user interface. A sensor can also be configured to measure the actual gas/air temperature inside the chamber. In one implementation, the temperature sensor 40 may utilize cholestric liquid crystals (CLC). The temperature of the CLC is initially at room temperature. As the user successively breathes (inhales/exhales) through the device, the CLC will expand and contract depending on the temperature. Depending on the temperature, the color of the indicator will change, which also is indicative of, and can be correlated with, the length of time the user has been breathing through the device.

In one embodiment, an analog product line is used, which exhibits a line that moves throughout the temperature cycle and provides a direct correlation to the elapsed time of use. The temperature indicator can be configured to provide for an indication of temperature at least in a range from room temperature to slightly below the body temperature of the user, e.g., 37 degrees centigrade. A secondary temporal (e.g., minute) indicator can be located adjacent to the temperature indicator to provide an indication of how long the user has been using the device, with the temperature being correlated with the elapsed time. Again, the indicator can be configured to hold a reading, and then reset for subsequent and repeated use.

The training device can be coupled to an aerosol delivery device (not shown), such as a nebulizer or metered dose inhaler, to deliver medication to the user through the chamber and patient interface. In this way, the device performs two (2) functions, (1) respiratory muscle endurance training and (2) treatment for respiratory ailments or diseases such as COPD or asthma. In one embodiment, the metered dose inhaler is engaged through an opening formed in the valve chamber 7.

The materials used to manufacture the device may be the same as those used to make the AEROCHAMBER holding chambers available from Trudell Medical International of London, Ontario, Canada, which chambers are disclosed in the patents referenced and incorporated by reference above. The diameter of the chambers 10, 2, 3 can range from between about 1 inch to about 6 inches. Although shown as cylindrical shapes, it should be understood that other cross-sectional shapes would also be suitable, including elliptical and rectangular shapes, although for devices also used for aerosol delivery, a cylindrical or elliptical shape is preferred to minimize impaction and loss of medication prior to reaching the patient.

Alternative embodiments of a respiratory muscle endurance training (RMET) system 50 are illustrated in FIGS. 2-9. In these embodiments, a tube 52 is connectable with a chamber which may have a fixed volume portion 54 defined by a housing 56. A flexible bellows 58 defines an adjustable volume portion 60. The tube 52 may be of a diameter ranging from 22 mm to 40 mm that provides a dead space volume (also referred to as rebreathing gas) of between 10 cubic centimeters (cc) to 40 cc per inch. The length may be varied between 10 inches to 36 inches in one embodiment. The tube 52 may be corrugated tubing made of polyvinyl chloride (PVC) and have markings every six inches for reference when cutting to a desired length. The fixed volume portion 54 defined by the housing 56 may be manufactured in two sections to enclose 1600 cc, however it may also be produced to have a volume in a range from 500 cc to 1600 cc in order to cover an expected range of patients from the small and thin to the large or obese.

Figure 2:
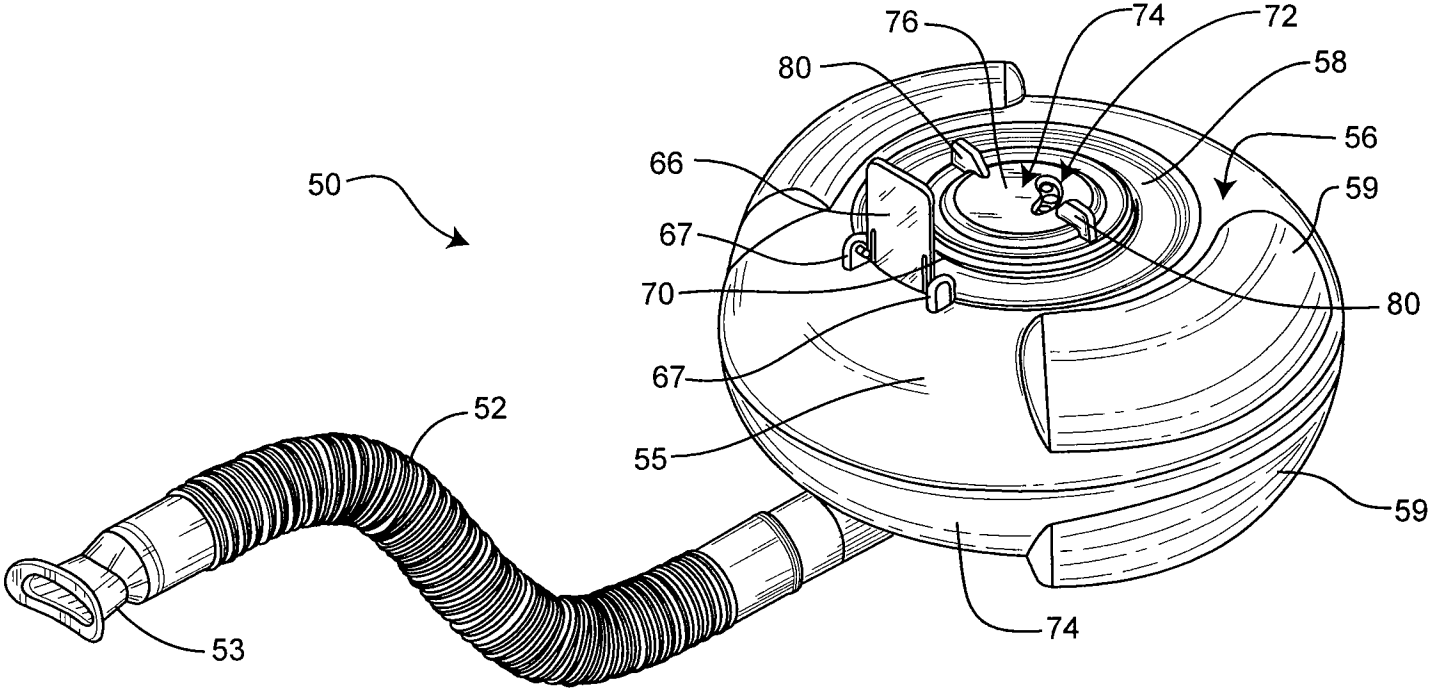
FIG. 2 is a perspective view of an alternative embodiment of the respiratory muscle endurance training device of FIG. 1.
Figure 3:
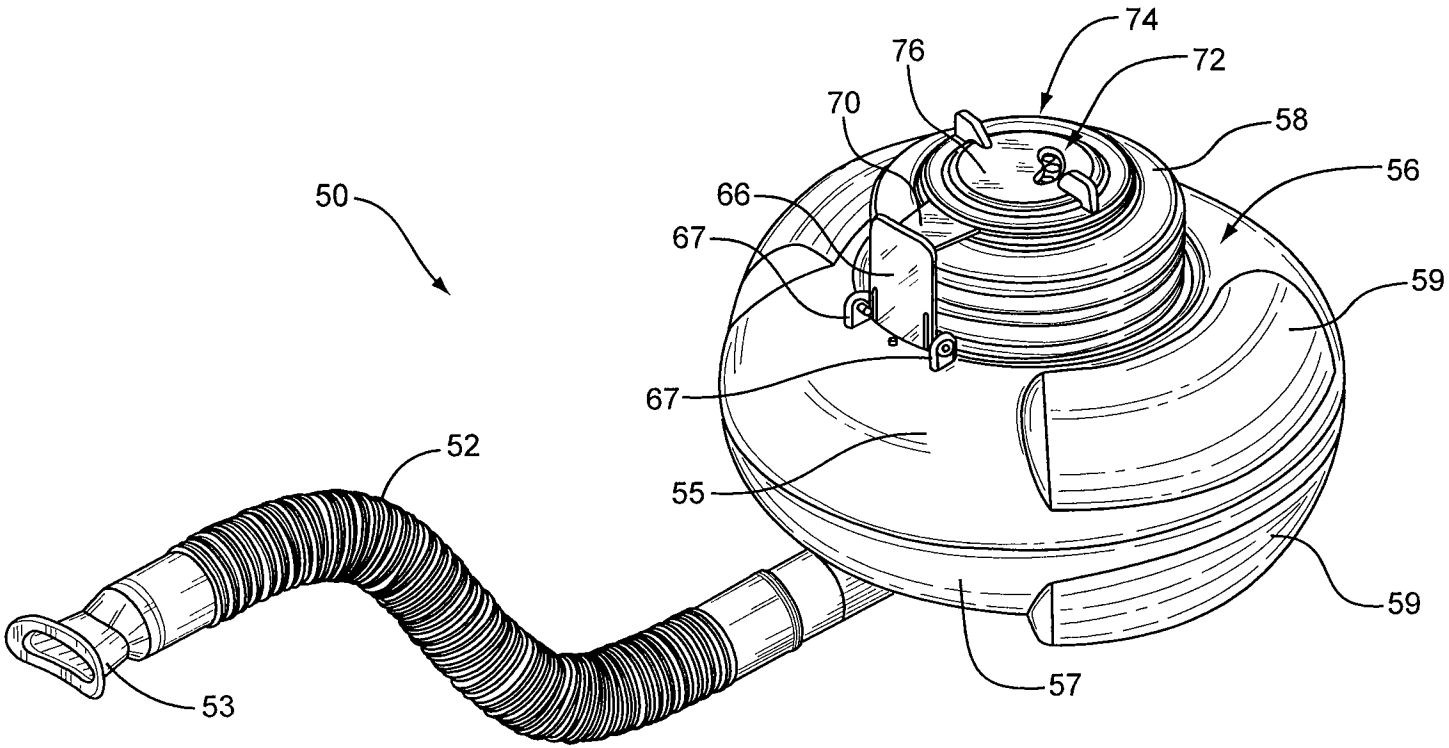
FIG. 3 is a perspective view of the device of FIG. 2 during exhalation with raised bellows.
Figure 4:
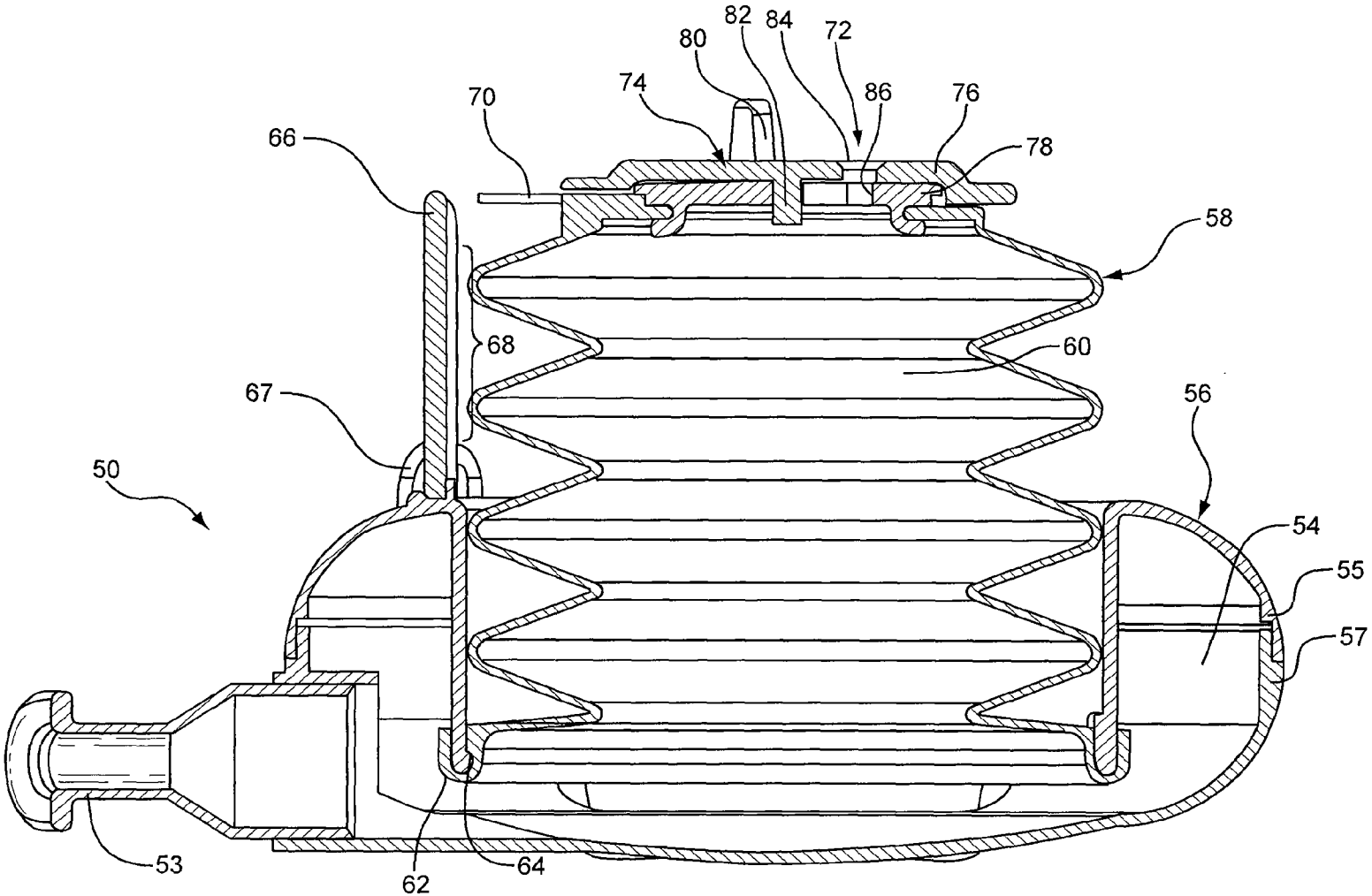
FIG. 4 is a cross-sectional view of the device of FIG. 3 without a flexible tube.

The housing 56 may be constructed from a polypropylene material or any of a number of other molded or formable materials. The housing may be manufactured in two halves 55, 57 that are friction fit together, glued, welded or connected using any of a number of know connection techniques. Also, the housing 56 may be fashioned in any of a number of shapes having a desired fixed volume. Hand rests 59, which may also be used as device resting pads, may be included on the housing 56. The bellows 58 may be manufactured from a silicone or other flexible material and connected with the housing 56 at a seal defined by a rim 62 on the housing 56 and a receiving groove 64 on the end of the bellows 58 that is sized to sealably grip the rim 62. In other embodiments, the bellows may be replaced with a balloon or other expandable body suitable for accommodating variable volumes. In the implementation of FIGS. 2-4, the housing 56 may have a diameter of 6 inches and a height of 3.5 inches. Other sizes may be fabricated depending on the desired volume of gases.

As best shown in FIG. 2, the bellows 58 may be contained within the housing 56 when no breathing is taking place using the system 50. FIGS. 2-3 illustrate the RMET system 50 with the bellows extended as a patient exhales. A volume reference member 66 having a scale 68 applied thereto or embedded therein may be mounted on the housing 56. The scale may be a linear scale such as a scale indicating increments of cc's, for example 100 cc increments from 0 to 500 cc. In one embodiment, the volume reference member 66 is foldable against the housing 56 by hinges 67 on the housing to permit a compact profile when not in use. An indicator 70 connected with the bellows 58 moves with the bellows 58 during breathing so that its position adjacent the volume reference member 66 on the housing 56 will provide information relating to the volume for each patient breath. FIG. 2 illustrates the RMET system 50 when the bellows 58 are fully retracted, such as when the device is at rest or a patient is inhaling. FIGS. 3-4 illustrate the system 50 with bellows 58 extended during patient exhalation.

The cap 74 on the bellows 58 defines a variable orifice 72 which may control the upper movement of the bellows 58 and define the final volume of the adjustable volume portion 60. The variable orifice 72 is set to allow excess exhaled gases to depart from the system to help prevent the patient from inhaling more than a desired percentage of the exhaled gases. In one embodiment, 60% of exhaled gases are desired for inhalation (rebreathing). In the RMET system 50 of FIGS. 2-4, the variable orifice 72 also acts to allow fresh, inspired gases to enter into the system 50 when the patient inhales more than the volume contained in the system 50. In this manner, the additional 40% of gases necessary after the 60% of exhaled gases have been inhaled may be breathed in. Preferably, there are no valves in the variable orifice 72 in order to allow the gases to flow freely through the system. By adjusting the resistance of the variable orifice 72 to flow on exhalation, the height of the bellows is adjusted during exhalation and the desired mix of exhaled and fresh gases may be selected (in this example 60/40).

Figure 5:
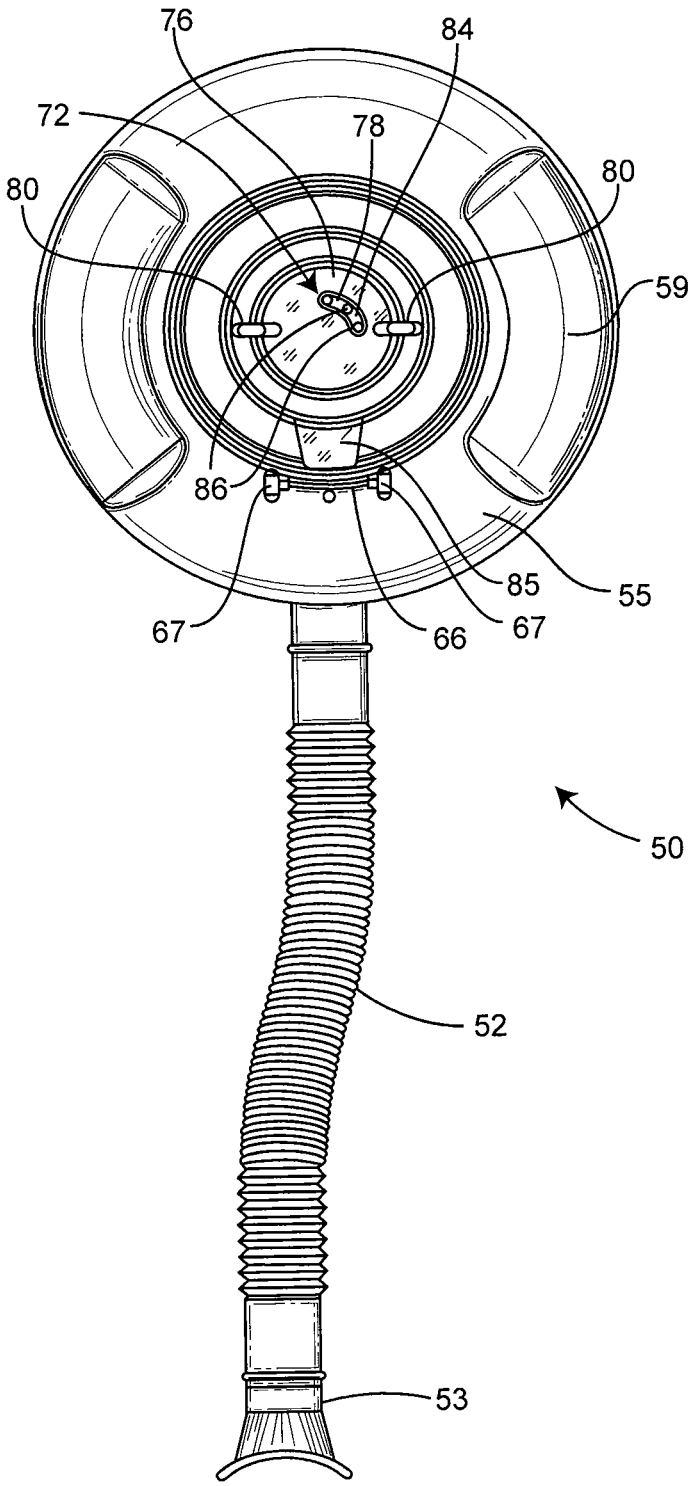
FIG. 5 is a top view of the device of FIGS. 2-3.
Figure 6:
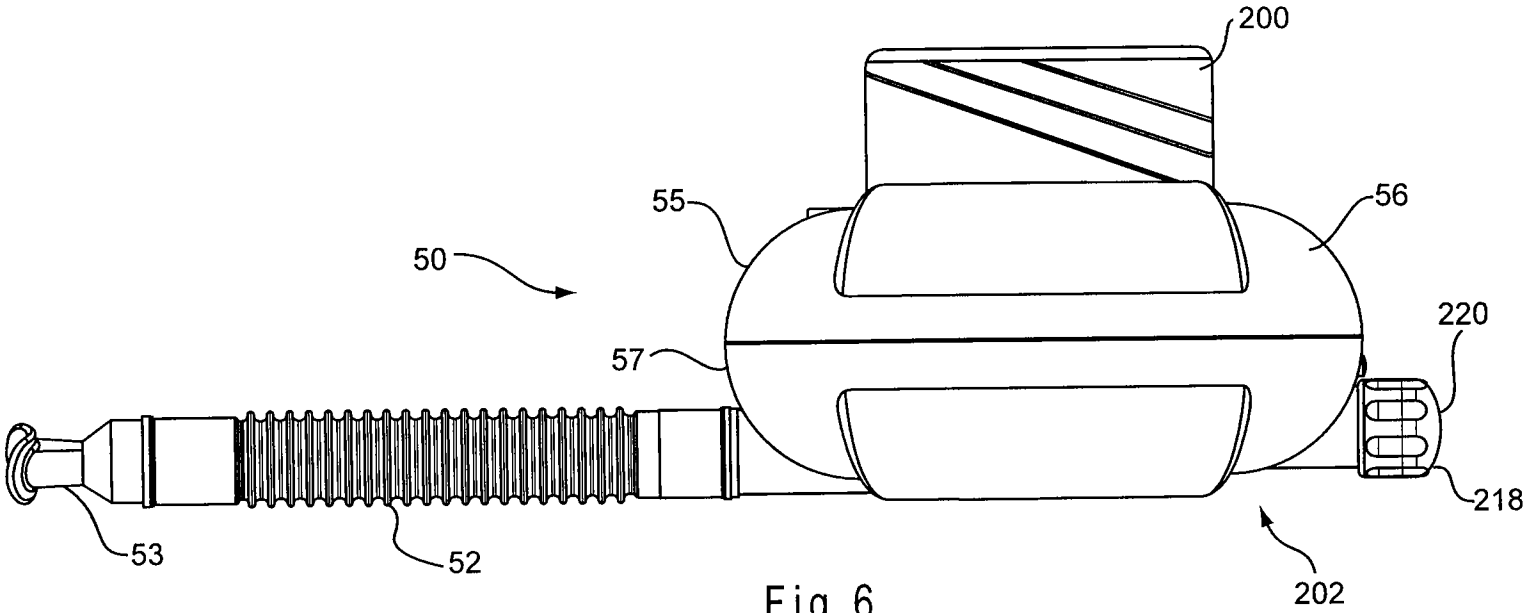
FIG. 6 is a side view of another alternative embodiment of the respiratory muscle endurance training device.
Figure 7:
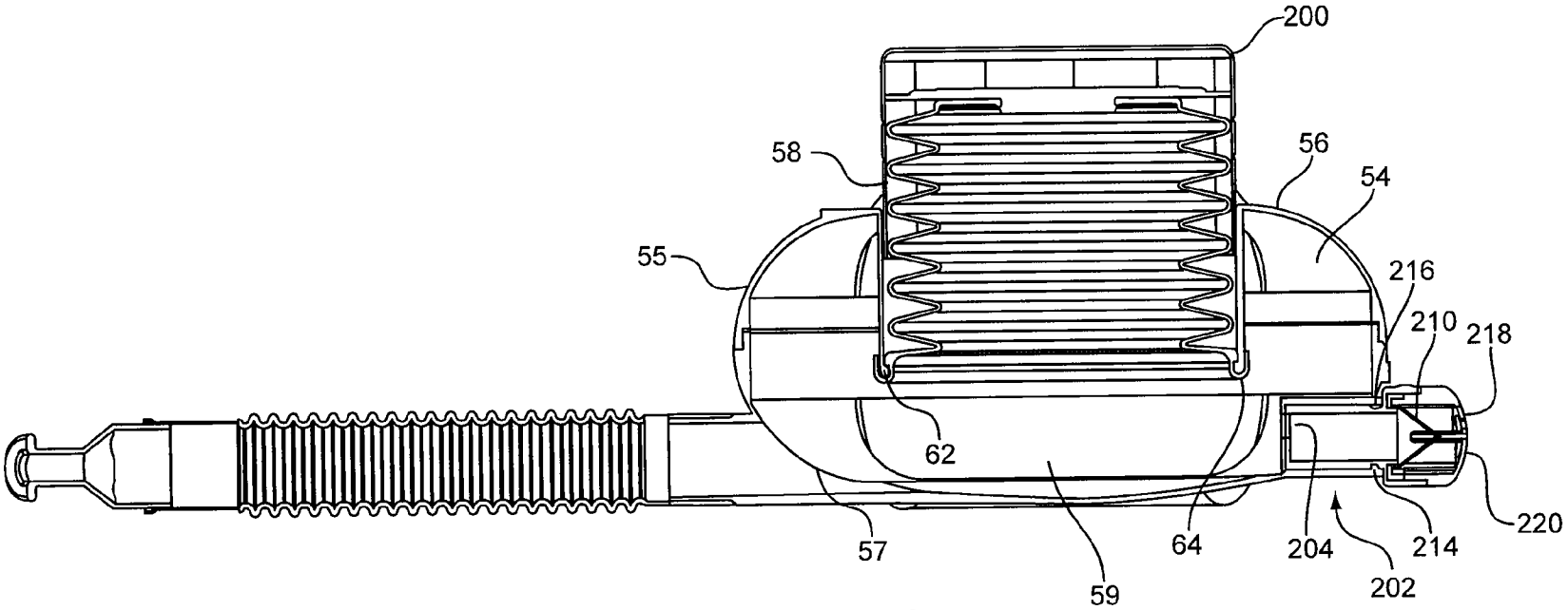
FIG. 7 is a cross-sectional view of the device of FIG. 6.
Figure 8:
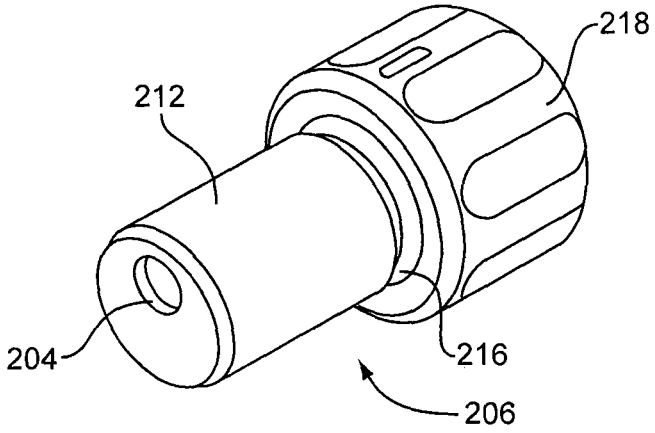
FIG. 8 is an enlarged perspective view of a port assembly incorporated into the embodiment of FIG. 6.
Figure 9:
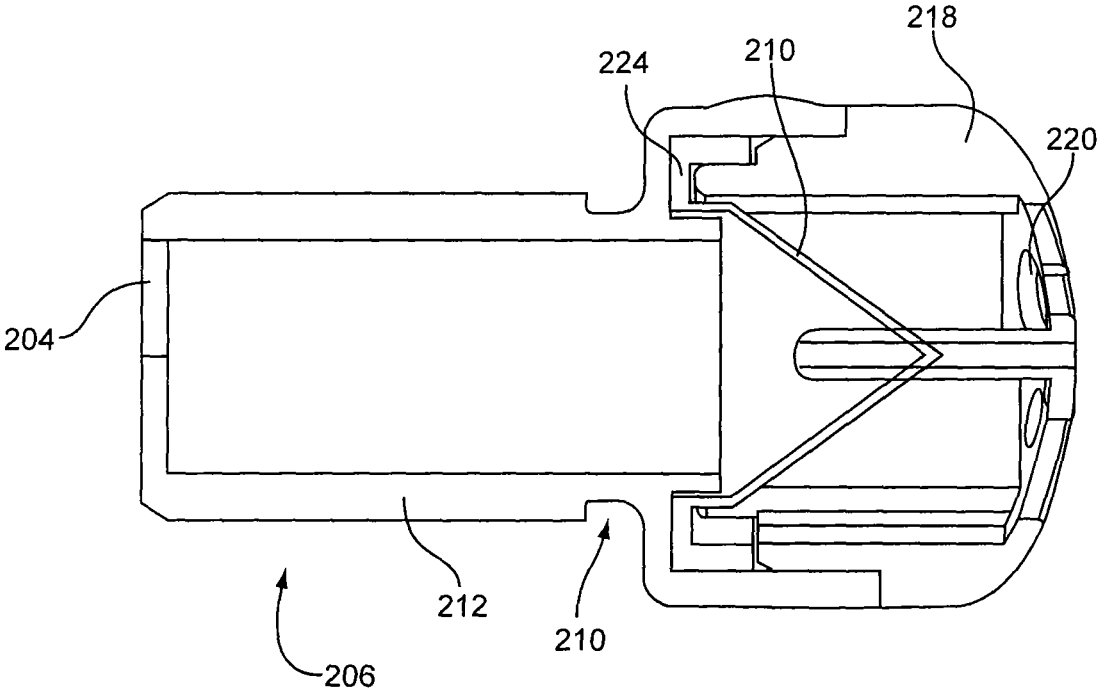
FIG. 9 is a cross-sectional view of the port assembly shown in FIG. 8.

Referring to FIGS. 4-5, the variable orifice 72 may be formed by overlapping portions, where an upper portion 76 has an opening 84 that may be rotated with respect to an underlying portion 78 to selectively expose all or a portion of one or more openings 86 in the underlying portion. The variable orifice 72 may be adjusted by pushing against grips 80 extending out from the upper portion so that the upper portion will rotate about a central axis. By pushing against the grips 80 and turning the upper portion 76 with respect to the lower portion 78 about a central axis 82, the opening 84 in upper portion 76 may be aligned with one or more openings 86 in the lower portion 78. Although a rotatable arrangement is illustrated, other arrangements to vary an opening size are contemplated.

Referring to FIGS. 6-9, a cap or outer cover 200 is disposed over the bellows to protect the bellows and provide a space for them to expand into. The cover is adjustably moveable relative to the housing 56. The cover can be made of a transparent material so as to provide the user or caregiver with a view of the bellows and its state of expansion, or other indicia that may be provided inside the cover such as a volume reference number.

In addition, a port 202 is formed in the housing and communicates with the fixed volume reservoir 54. In one embodiment, the port 202 is configured as a separate assembly 206 that is disposed in a channel formed in the housing. The port assembly includes an insert portion 212 that is secured in the housing channel with a press fit, snap fit, mechanical or detent fasteners, bonding, etc., or combinations thereof. For example, the housing can be configured with a rib 214 that engages a corresponding recess in the insert portion. In other embodiments, the port assembly can be integrally formed with the housing. In either embodiment, the port includes an orifice 204, configured in one embodiment as an opening 6 mm in diameter, although other size openings and dimensions may be suitable. If the port assembly is made separate from the housing, the housing may also include an orifice having the same or greater size than the port orifice, with the orifices being aligned.

The port is further configured with a valve 210 disposed downstream of the orifice in the port assembly. The valve opens during exhalation. The valve can be configured as a one-way butterfly valve, although it should be understood that other types of valves, including annular valves, slit petal valves, center post valves, valves having a central opening with a peripheral sealing edge etc. can be used. The valve, while configured as a one-way valve, can also operate to a certain extent as a two-way valve, permitting a limited amount of ambient air to be entrained through the valve during inhalation before sealing up completely. Of course, as disclosed above with respect to the embodiment of FIG. 1, other combinations of inhalation and exhalation valves can be used in the port, whether separately provided or integrally formed so as to provide one-way inhalation or exhalation, or two-way inhalation and exhalation. In addition, while the port and valve are shown in communication with the fixed volume chamber, the port and valve could also be connected to and disposed in communication with the variable volume chamber.

A cover 218, including a convex outer portion having at least one opening 220 and in one embodiment a plurality of openings, is secured to the end of the port, for example by press. In one embodiment, annular flange 224 of the valve is secured between the cover 218 and the port housing. The cover 218 also protects the valve and prevents tampering therewith.

The user fills and empties the reservoir 60 completely during inspiration and expiration, while also inhaling additional fresh air through the port 202 during inspiration and breathing partly out through the port 202 during expiration. The valve 210 closes as the patient empties the reservoir unit 60 during inspiration. This assures constant Tidal Volume while breathing through the system. The port 202 and valve 210 can be used in place of the variable orifice 72 of the embodiment in FIGS. 3-5, or in conjunction therewith. Likewise, the volume reference number 66 can be incorporated into the embodiment of FIGS. 6-9.

The size of the reservoir is adjusted to 50% to 60% of the subject's Vital Capacity. The breathing frequency is set at 60% of the patient's Maximum Voluntary Ventilation (MVV). To prevent Hypocapnia during breathing the reservoir volume is increased and hypercapnia is corrected by decreasing the reservoir volume. The user can also wear a nose clip to ensure that hey are breathing exclusively through the breathing device.

Referring to FIGS. 10-21C, a REMT system may be assembled from seven components. The REMT system allows for the patient to rebreathe 50-60% of the previous exhaled gases known as normocapnic hyperpnea to stimulate exercise training of the respiratory muscles. This inspiratory muscle training may have beneficial effects in certain patients with chronic obstructive pulmonary disease.

Figure 10:
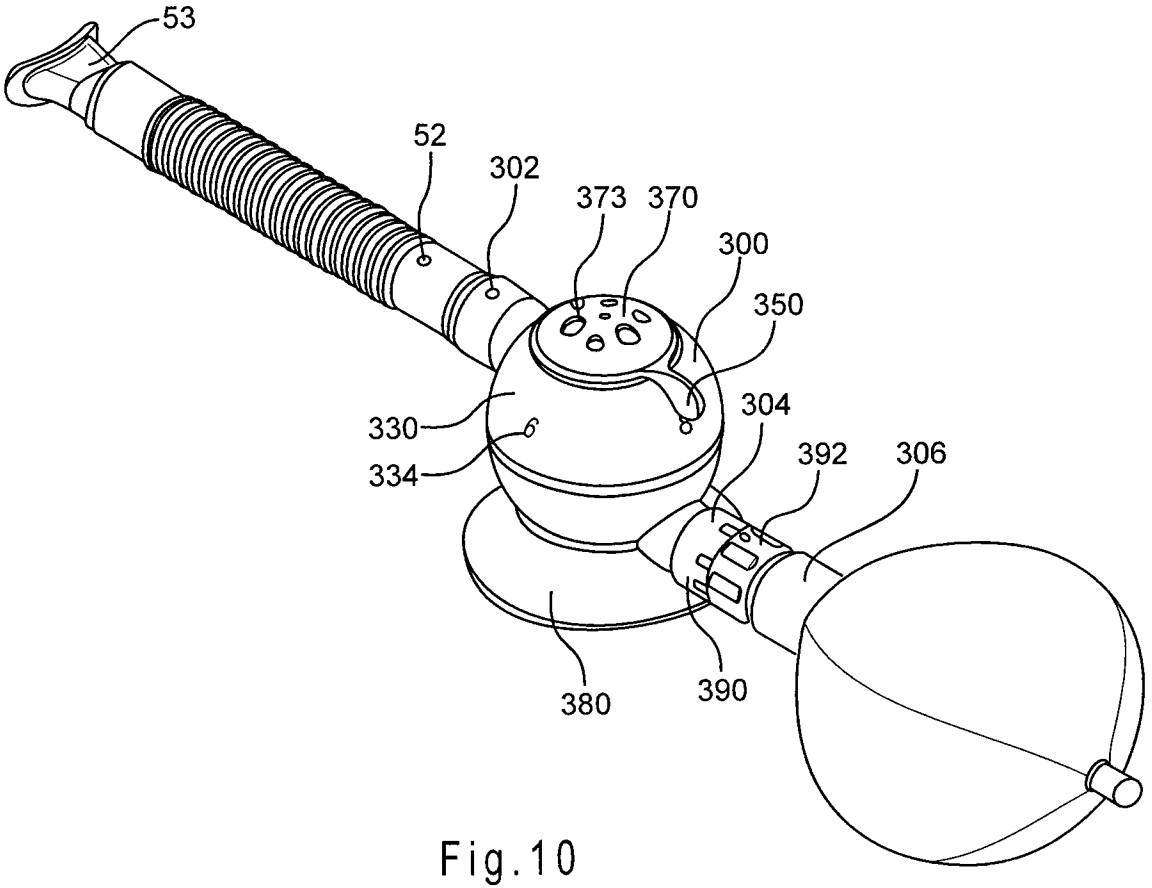
FIG. 10 is a perspective view of another embodiment of a respiratory muscle endurance training device.
Figure 11:
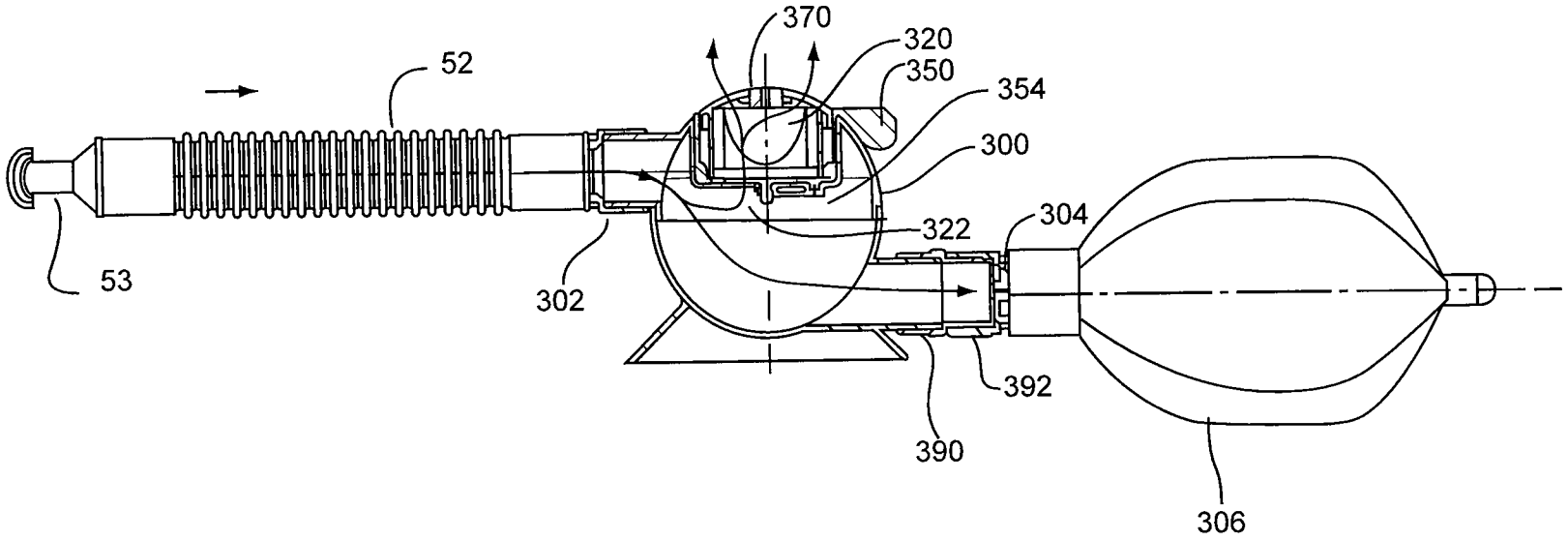
FIG. 11 is a partial cross-sectional view of the device shown in FIG. 10 during an exhalation sequence.
Figure 12:
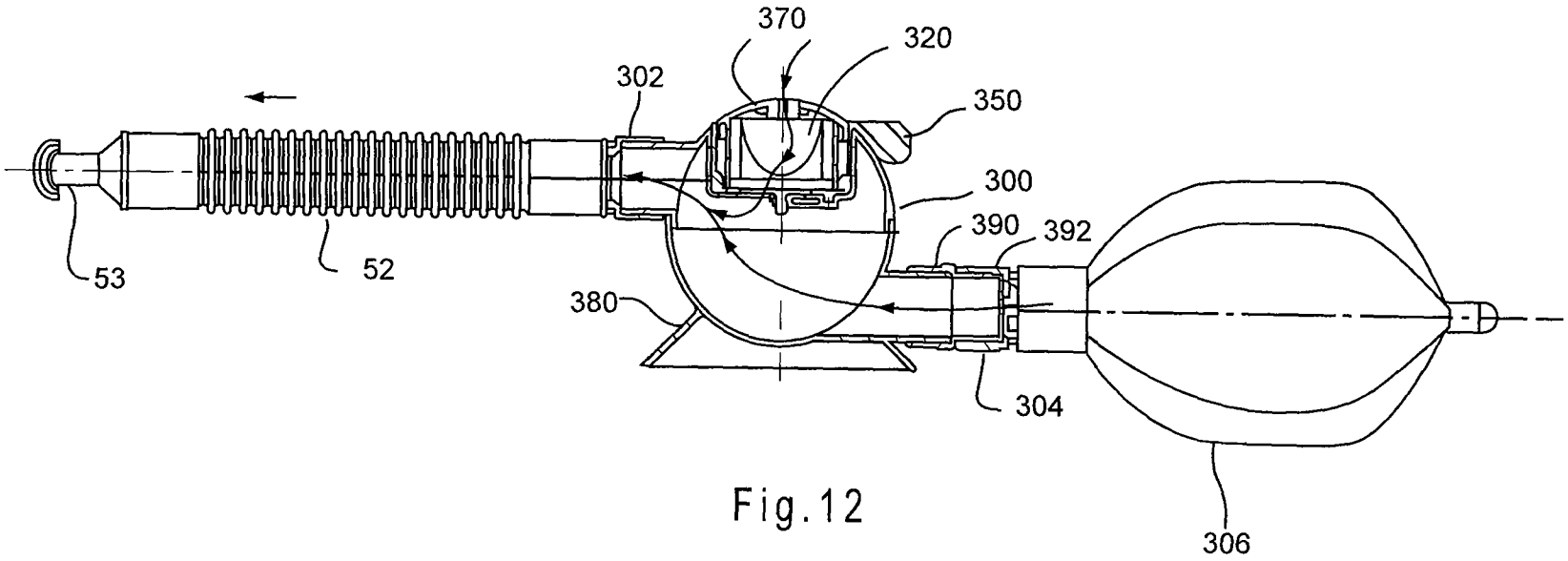
FIG. 12 is a partial cross-sectional view of the device shown in FIG. 10 during an inhalation sequence.
Figure 13:
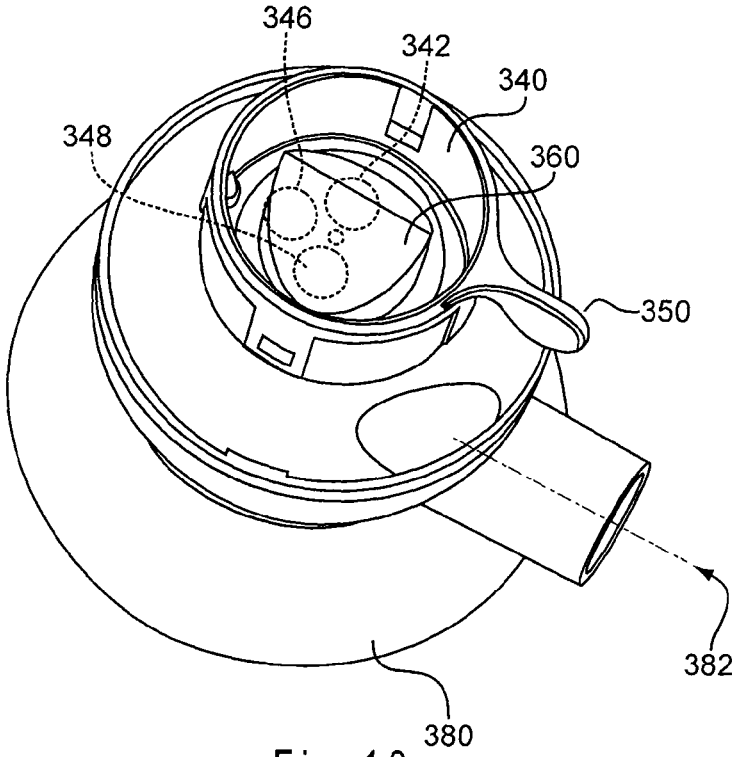
FIG. 13 is a partial top view of the chamber shown in FIG. 10 with a top portion and valve cover removed.
Figure 14:
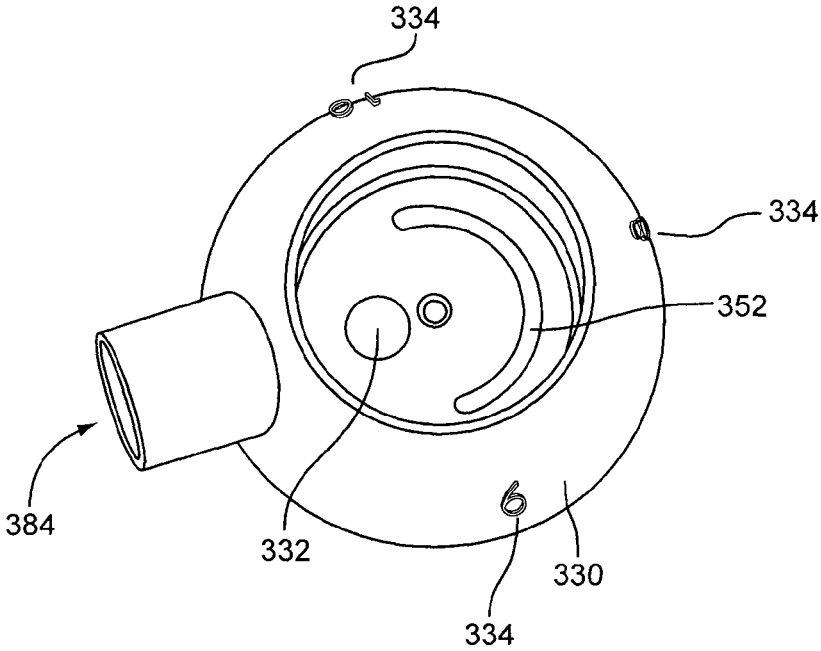
FIG. 14 is a partial top view of a top portion of the chamber shown in FIG. 10.
Figure 15:
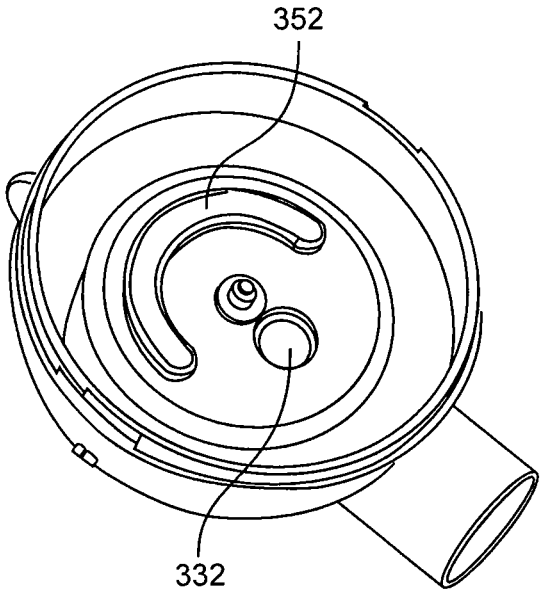
FIG. 15 is a partial bottom view of the top portion of the chamber shown in FIG. 14.
Figure 16:
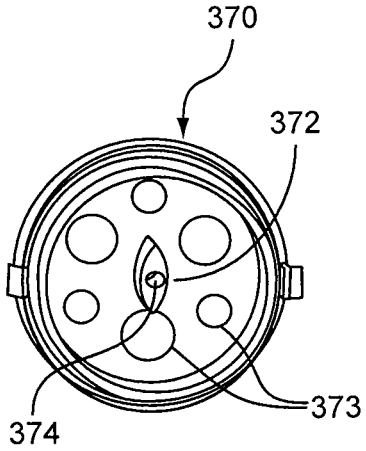
FIG. 16 is a bottom view of a valve cover.

Referring to FIGS. 10-12, the REMT device includes a mouthpiece 53, tubing 52 (including for example and without limitation corrugated tubing), a swivel connector 302, chamber 300, swivel connector with an adjustable orifice 304, and a rebreathing bag 306, having for example and without limitation a 1 to 2 liter capacity. The chamber 300 provides a fixed volume chamber, while the rebreathing bag provides a variable volume chamber.

Figure 17:
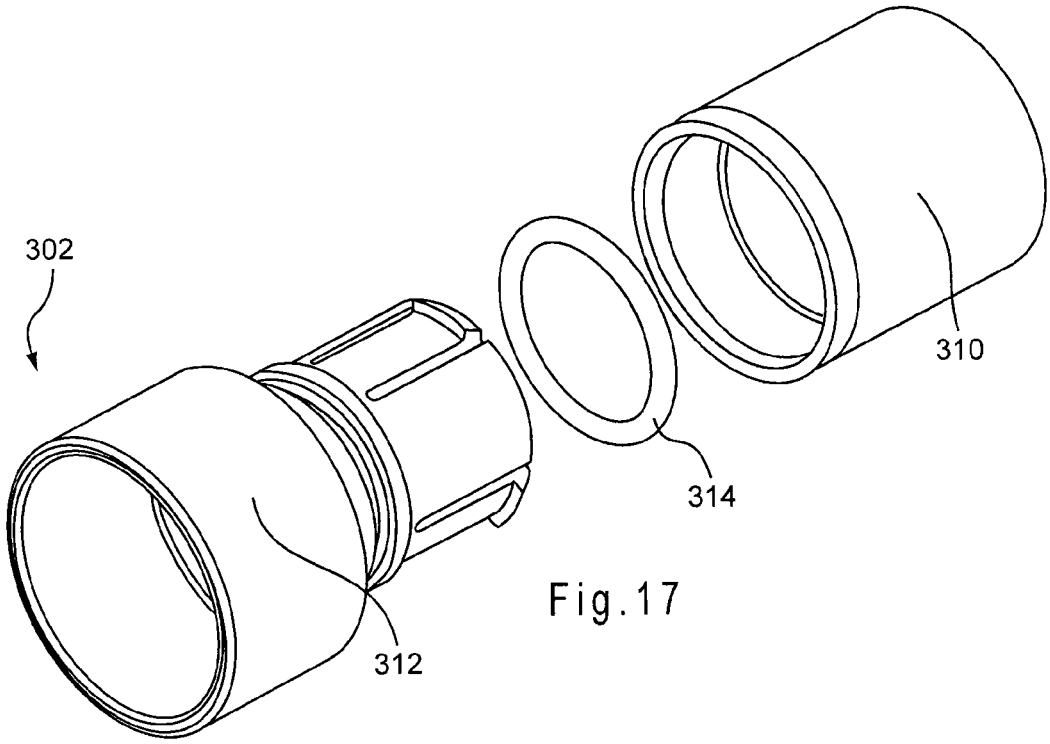
FIG. 17 is an exploded perspective view of a swivel connector.
Figure 18:
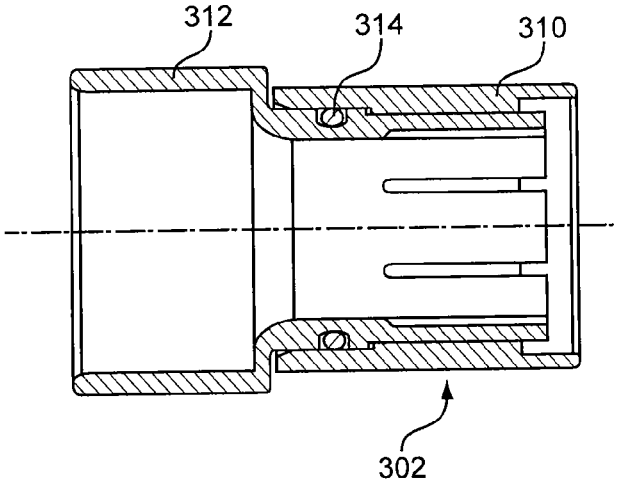
FIG. 18 is a cross-sectional view of the swivel connector shown in FIG. 17.
Figure 19:
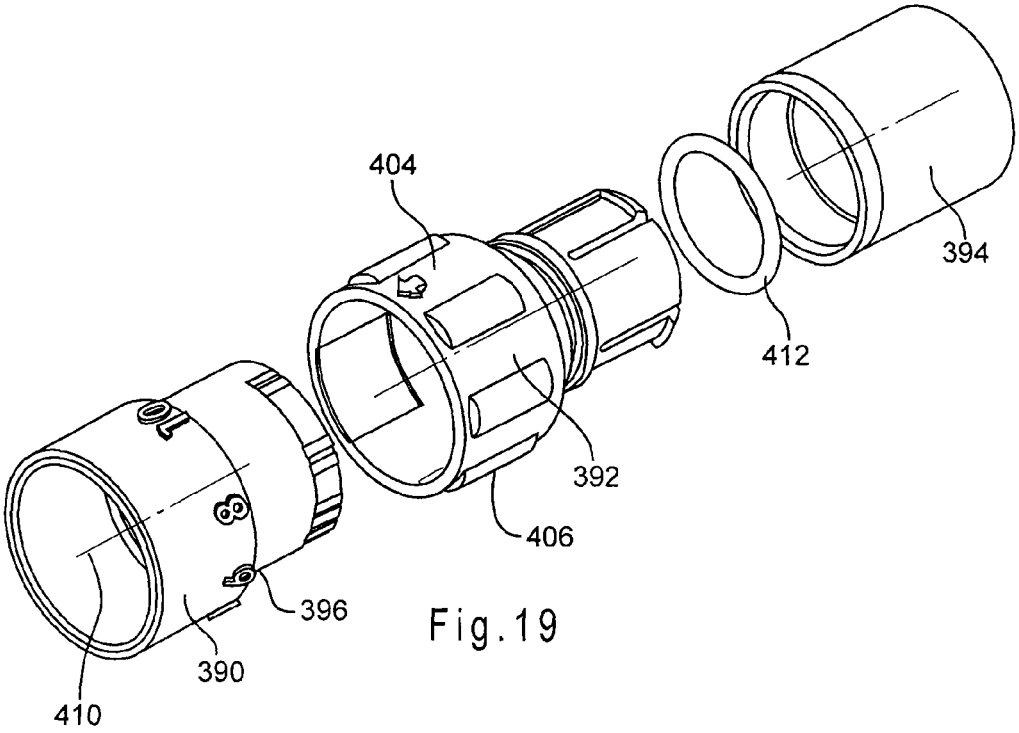
FIG. 19 is an exploded perspective view of a second swivel connector.
Figure 20:
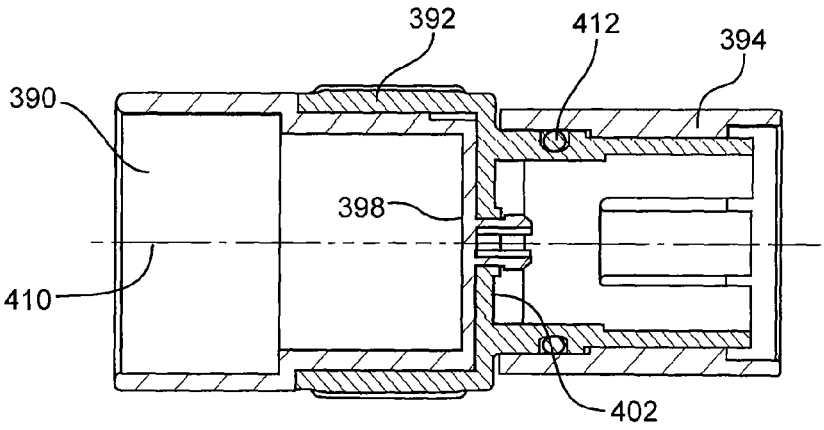
FIG. 20 is a cross-sectional view of the swivel connector shown in FIG. 19.
Figures 21A, 21B, 21C:
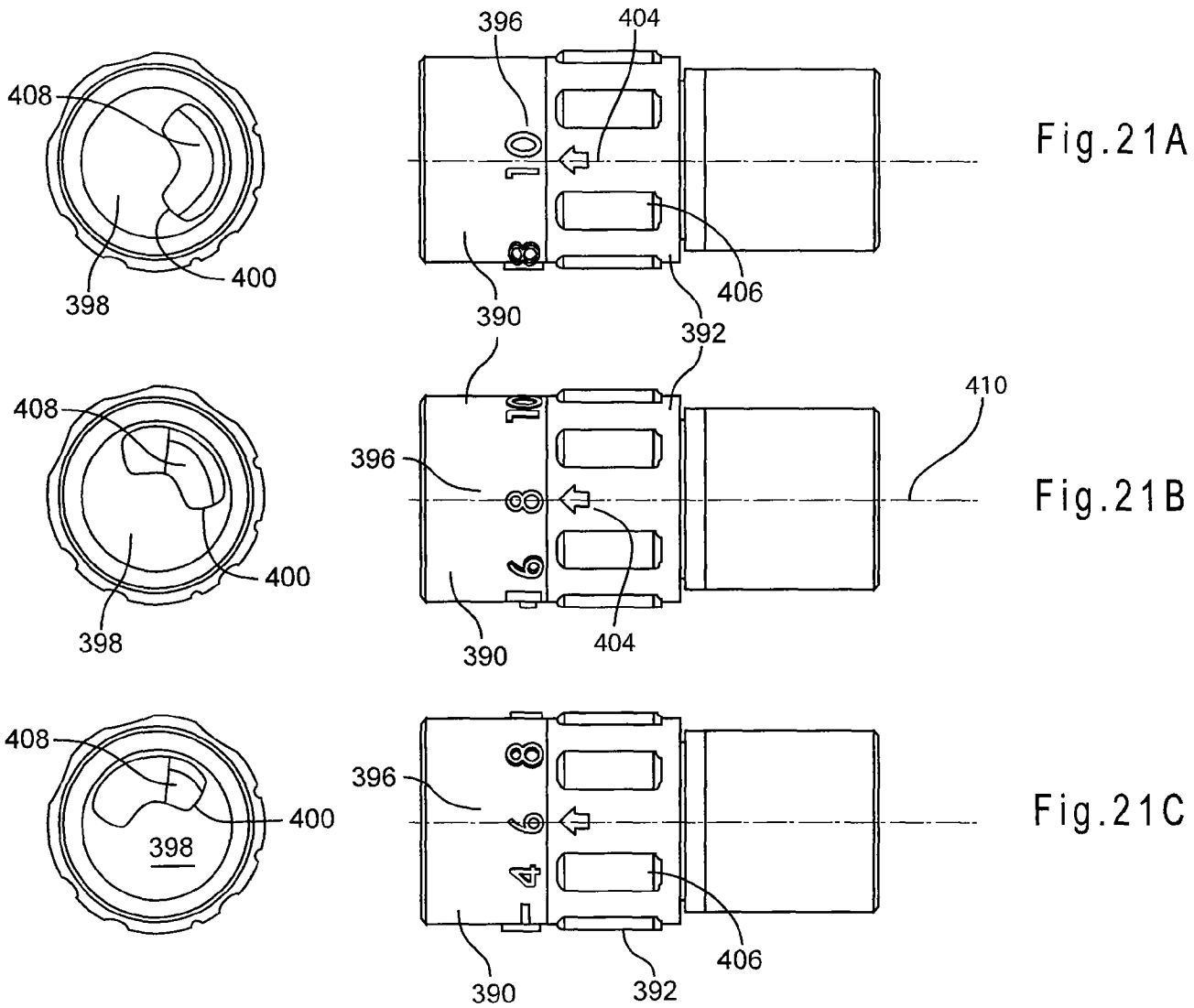
FIGS. 21A-C are combined side and end views of the swivel connector shown in FIG. 19 with the variable opening positioned at different settings.

Referring to FIGS. 10, 17 and 18, the swivel connector 302 may be configured with a 22 mm inner diameter at one end 312 and a 22 mm outer diameter on the other end 310. As shown in FIG. 10, the swivel connector is attached to the chamber opening 308 at one end 310 and the tubing 52 on the other end 312. The end portions of the connector are rotatable relative to each other. An O-ring, or other seal, is disposed between the components 312, 310. The swivel connector provides for the corrugated tube 52 to easily mate with and rotate relative to the chamber 300.

The mouthpiece 53, tubing 52, and swivel connector 302 each have a known volume, which are incorporated and included in the rebreathing of exhaled gases with a known volume of exhaled gases. In addition, the volume of the chamber 300 and the accumulated volume of the rebreathing bag 306 as set by the user. In one embodiment, this total volume may represent between 50-60% of the total gas the patient will inhale during each breath.

Referring to FIG. 11, the route of the patient's exhaled gases is shown. In particular, a portion of the exhaled gas will pass through the restrictor swivel connector adjustable orifice 304 into the reservoir, or rebreathing bag 306. The excess available exhaled gas will pass through the chamber 300 to the ambient atmosphere, and in particular, will pass through the one-way valve 320 and variable orifice 322 in the chamber 300.

Referring to FIG. 12, the route of the inhaled gases is shown. In particular, gases may enter into the REMT chamber 300 from the outside of the chamber as well as from the reservoir or rebreathing bag 306 through the swivel connector 304 with the adjustable orifice. The combination of the two gas flows will provide the patient with a 50 to 60% rebreathing of exhaled gas collected in the system with each inhalation.

Referring to FIGS. 13-16, the chamber 302 may include a base 380 and a top 330 secured to the base. The top 330 has a 10 mm hole 332 opening in a center portion thereof. A movable valve holder 340 is configured with a plurality of openings 342, 346, 348, shown as three (dashed lines in FIG. 13). In one embodiment, the openings have respective diameters of 10, 8, and 6 mm. It should be understood that other size openings between 0 and 10 mm in diameter, or a different number of openings with different diameters can be provided. In addition, openings having non-circular shapes also can be provided. The openings in the valve holder 340, which is rotatably connected to the top 330 and rotates about a vertical axis, interface with the 10 mm opening 334 in the top to create a variable size opening for the inhale/exhale gases to pass into and out of the chamber.

The valve holder 340 includes a grippable member 350, such as a lever shaped to be engaged by a thumb, which permits the user to rotate the valve holder to a desired setting. The outside of the top 330 is provided with indicia 334, such as alphanumeric indicia, shown as numbers 6, 8 and 10, which align with a marker, configured as the grippable member 350. In this way, the user sets the size of the variable opening 322, defined by the interface of the openings 332 and 342, 346 and 348, by moving the marker to the desired indicia 334. The indicia may also include color coding, tactile indicia, text, symbols, alphanumeric characters, or combinations thereof. The top 330 includes a semi-circular groove 352 or track, in which a guide member 354 on the valve holder moves.

A valve 320, shown as a duck bill valve, is positioned between the openings and the ambient environment. The valve prevents a sudden inhalation of ambient or fresh gas/air due to a rapid inhalation from the subject. This is accomplished by the valve prevent substantial amounts of fresh/ambient gases from entering into the system. Any sudden inhalation of fresh/ambient air/gases may prevent the system from properly mixing the expired gases with the inhaled gases during inhalation procedure, or may otherwise result in a mixture outside of the 50-60% mixture of inhalation/exhalation gases.

A valve cover 370 is configured with a spacer 372, configured in one embodiment for example and without limitation with an oval or elliptical cross section, which passes through the center of the duck bill valve 320 so as to maintain the valve in a partially open state. The spacer 372, configured as a rod, is further configured with a passageway 374, or safety hole, shown as a 2 mm hole, which allows the patient to always have access to some atmosphere air if they completely empty the reservoir bag during inhalation. This will avoid a total stoppage of inhaled air during the patient's inhalation sequence due to an extra effort upon inhalation. Once the reservoir bag 306 is collapsed the patient will feel the resistance in the system through their breathing pattern and the patient will tend to stop inhaling and start to exhale. This keeps the breathing process continually operational. The cover 370 is further provided with a plurality of openings 373 that allow the gases to pass from and to the ambient environment. The cover prevents access to and tampering with the valve.

The base 380 has an opening 382, which may be a 22 mm opening, and which connects to the swivel connector with a variable orifice. The top is attached to the base and has an opening 384, which may be a 22 mm opening, to which the tubing is connected.

Referring to FIGS. 19-21C, the swivel connector 304 with a variable orifice is shown as including a first end component 390, an intermediate component 392 and a second end component 394. Indicia 396, shown for example as numerical indicia, are disposed circumferentially around an outer surface of the first end component 390. The indicia located on the outside surface correspond to the setting of a variable orifice, and in one embodiment may identify the size of the orifice at a particular setting, for example the number of millimeters in diameter the opening will be inside the connector. The size of the variable opening may control the amount of expired volume of gas collected in the reservoir or rebreathing bag 306, which may be determined by the flow of the gas from the patient and the size of the opening set at the output of the chamber 300.

The first end component 390 may have a 22 mm opening and connects to the chamber 300, and in particular the base 380 opening 382. An interior wall 398 has a curved moon 6 mm opening 400 across the flow path of the connector. The intermediate component 392 also is configured with an interior wall 402 extending across the flow path. The intermediate component has a grippable surface, including for example and without limitation a plurality of ribs 406. A marker 404 is provided on an exterior surface of the intermediate component. The interior wall is configured with a curved 6 mm opening 408. The intermediate component 392 is secured to and rotatable relative to the first end component 390 about a longitudinal axis 410, such that the two openings 400, 408 may interface and intersect so as to create a variable opening, having areas substantially the same as corresponding circular openings of varying diameter (4 mm, 6 mm, 8 mm, etc.). It should be understood that the openings can be configured in various shapes not limited to the curved opening shown, such as circular openings. In any event, the larger the combined opening, the greater the volume of exhaled air that may accumulate in the reservoir or rebreathing bag 306. A seal 412, for example an O-ring, is disposed between the intermediate component 392 and the second end component 394, which in turn interfaces with the rebreathing bag 305. In this way, the rebreathing bag can be rotated relative to the chamber 300, for example by rotating the second component 394 relative to the intermediate component 392, without resetting or varying the size of the orifice. Rather, the size of the orifice is controlled by rotating the intermediate component 392 relative to the first end component 390.

In operation of the various systems, a patient first exhales into the patient interface, which may be a mouthpiece 53, mask or other interface on the end of the corrugated tubing 52. Upon the subsequent inhalation, the patient will inhale expired gases located in the corrugated tubing 52, the fixed volume portion 54, 300 and the adjustable volume portion 60, 306 in addition to any additional fresh gas (such as ambient air) entering into the system through the variable orifice 72 on the flexible bellows 58 or on the chamber 300. The amount of exhaled gases may be set to be approximately 60% of the maximum voluntarily ventilation (MVV). To calculate how the level of ventilation may be set to approximately 60% of MVV, one may multiply 35×FEV1 (forced expiratory volume in the first second). This results in the relationship of 60% MVV=0.6×35×FEV1. The dead space of the RMET system 50, in other words the amount of volume for holding exhaled gases, may be adjusted to 60% of the patient's inspiratory vital capacity (IVC). The breathing pattern of the patient must be set above the normal breaths per minute, which is generally 12 to 15 breaths per minute. A breathing pattern between 16 to 30 breaths per minute may be suitable depending on the patient. In the embodiments as described herein, the breathing pattern is preferably 20 breaths per minute. The embodiments as described herein may comprise a visual or audible indicator to assist the patient in establishing the desirable breathing pattern. For example, where the desired breathing pattern is 20 breaths per minute a visual indicator, such as a light, would flash on and off every 3 seconds prompting the patient to inhale every time the light is on or every time the light turns off. The visual or audible indicator could be located adjacent the volume reference member 66. Although a mouthpiece 53 may be directly connected with the housing 56 as shown in FIG. 4, the tubing 52 shown in FIGS. 2-3 permit greater flexibility in customizing the amount of exhaled air retained in the system 50.

Assuming that, on average, a COPD patient's IVC is approximately 3.3 liters, 60% of 3.3 liters is approximately 2 liters. To achieve this capacity with the RMET system 50, an accumulation of a fixed volume plus a variable volume is used. The fixed volume with a flexible tubing 52 (120 cc to 240 cc) plus a fixed volume portion 54 of 1600 cc defined by the housing 56, along with a bellows 58 adjustable between approximately 0 cc to 400 cc accounts for the 60% of the IVC. During exhalation, 40% of the expired volume of gases may be expelled through the variable orifice 72 in the bellows 58. During inhalation, the patient may inhale the exhaled volume of gases in the system 50 and inhale the remaining 40% of gases necessary to complete the IVC through the variable orifice 72 on the bellows 58. To adjust the volume of expired gases collected from the patient, it is possible to reduce the length of the corrugated tube and reduce the fixed volume of gas in the device.

The patient observes the movement of the indicator 70 against the scale 68 on the housing to determine that the 60% volume of the patient's IVC has been reached. A separate or integrated timing device (not shown), such as a mechanical or electronic timer emitting an audible and/or visible signal, can assist the patient to perform a breathing program at a sufficient rate of breaths per minute. It is contemplated that the initial setting of the RMET system 50 to 60% of a patient's specific IVC may be made by a caregiver. The caregiver or patient may, for example, use a pulmonary function machine to determine the patient's FEV1 which can then be used to calculate the patient's MVV and ultimately 60% of the IVC.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An adapter for a respiratory muscle endurance training device comprising:

a first component defining at least one first opening positioned and adapted to communicate with an interior of a chamber;

a second component rotatably coupled to said first component, said second component comprising at least one second opening positioned and adapted to communicate with an exterior of the chamber, said at least one first and second openings in combination defining an orifice adapted to provide a flow path between the interior and exterior of the chamber, wherein said first and second components are rotatable relative to each other between a plurality of positions, wherein portions of said at least one first opening and said at least one second opening overlap variable amounts such that said orifice is variable when said first and second components are rotated between said plurality of positions, wherein at least one of the first and second components comprises indicia corresponding to a size of said variable orifice.

2. The adapter of claim 1 wherein said first component comprises a portion of said chamber.

3. The adapter of claim 1 wherein said first component comprises a cylindrical mounting portion formed at a first end thereof.

4. The adapter of claim 3 wherein said second component comprises a cylindrical housing rotatably coupled to a second end of said first component.

5. The adapter of claim 4 further comprising a third component rotatably coupled to said second component.

6. The adapter of claim 1 wherein said first component comprises said indicia.

7. The adapter of claim 1 wherein said second component comprises a grippable portion.

8. The adapter of claim 7 wherein said grippable portion comprises a plurality of ribs.

9. An adapter for a respiratory muscle endurance training device comprising:

a first component defining at least one first opening positioned and adapted to communicate with an interior of a chamber;

a second component rotatably coupled to said first component, said second component comprising at least one second opening positioned and adapted to communicate with an exterior of the chamber, said at least one first and second openings in combination defining an orifice adapted to provide a flow path between the interior and exterior of the chamber, wherein said first and second components are rotatable relative to each other between a plurality of positions, wherein portions of said at least one first opening and said at least one second opening overlap variable amounts such that said orifice is variable when said first and second components are rotated between said plurality of positions, wherein said second component comprises a grippable portion, and wherein said grippable portion comprises a lever.

10. An adapter for a respiratory muscle endurance training device comprising:

a first component defining at least one first opening positioned and adapted to communicate with an interior of a chamber;

a second component rotatably coupled to said first component, said second component comprising at least one second opening positioned and adapted to communicate with an exterior of the chamber, said at least one first and second openings in combination defining an orifice adapted to provide a flow path between the interior and exterior of the chamber, wherein said first and second components are rotatable relative to each other between a plurality of positions, wherein portions of said at least one first opening and said at least one second opening overlap variable amounts such that said orifice is variable when said first and second components are rotated between said plurality of positions; and a valve disposed in said flow path.

11. The adapter of claim 10 wherein said valve comprises an exhalation valve.

12. The adapter of claim 10 further comprising a spacer interfacing with said valve to maintain said valve in at least a partially open state.

13. The adapter of claim 1 wherein said at least one first opening comprises an arcuate shaped opening.

14. The adapter of claim 1 wherein said at least one first and second openings comprise first and second arcuate shaped openings.

15. The adapter of claim 1 wherein said at least one first opening comprises a plurality of differently sized first openings.

16. The adapter of claim 1 wherein said at least one second opening comprises a plurality of differently sized second openings.

17. An adapter for a respiratory muscle endurance training device comprising:

a first component comprising a first end defining a mounting portion, said first component defining at least one first opening;

a second component rotatably coupled to a second end of said first component, said second component comprising at least one second opening, said at least one first and second openings in combination defining an orifice adapted to provide a flow path, wherein said first and second components are rotatable relative to each other between a plurality of positions, wherein portions of said at least one first opening and said at least one second opening overlap variable amounts such that said orifice is variable when said first and second components are rotated between said plurality of positions, wherein at least one of the first and second components comprises indicia corresponding to a size of said variable orifice; and a third component rotatably coupled to said second component opposite said first component, wherein said third component is rotatable relative to said second component independent of said rotatable position of said first component relative to said second component.

18. The adapter of claim 17 wherein said first component comprises a cylindrical mounting portion formed at said first end thereof.

19. The adapter of claim 18 wherein said second component comprises a cylindrical housing rotatably coupled to a second end of said first component.

20. The adapter of claim 19 wherein said third component comprises a cylindrical housing rotatably coupled to said second component.

21. The adapter of claim 17 wherein said first component comprises said indicia.

22. The adapter of claim 17 wherein said second component comprises a grippable portion.

23. The adapter of claim 22 wherein said grippable portion comprises a plurality of ribs.

24. The adapter of claim 17 wherein said at least one first opening comprises an arcuate shaped opening.

25. The adapter of claim 24 wherein said at least one second opening comprises an arcuate shaped opening.

26. The adapter of claim 17 wherein said at least one first and second openings comprise first and second arcuate shaped openings.

27. An adapter for a respiratory muscle endurance training device comprising:

a first component comprising a first end defining a mounting portion, said first component defining at least one first opening;

a second component rotatably coupled to a second end of said first component, said second component comprising at least one second opening, said at least one first and second openings in combination defining an orifice adapted to provide a flow path, wherein said first and second components are rotatable relative to each other between a plurality of positions, wherein portions of said at least one first opening and said at least one second opening overlap variable amounts such that said orifice is variable when said first and second components are rotated between said plurality of positions;

a third component rotatably coupled to said second component opposite said first component, wherein said third component is rotatable relative to said second component independent of said rotatable position of said first component relative to said second component; and a seal disposed between said second and third components.

28. The adapter of claim 27 wherein said seal comprises an O-ring.

29. The adapter of claim 17 wherein said third component comprises a cylindrical portion.

30. The adapter of claim 1 wherein said at least one second opening comprises an arcuate shaped opening.

* * * * *